US006600261B1

(12) United States Patent
Kitagawa

(10) Patent No.: US 6,600,261 B1
(45) Date of Patent: Jul. 29, 2003

(54) PLASMA LIGHT EMITTING DEVICE AND DISPLAY USING SAME HAVING AN ULTRAVIOLET LIGHT LEAKAGE PREVENTING MEANS

(75) Inventor: Koji Kitagawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/236,535

(22) Filed: Jan. 25, 1999

(30) Foreign Application Priority Data

Jan. 30, 1998 (JP) ..... 10-019108

(51) Int. Cl.[7] ..... H01J 1/62; H01J 63/04

(52) U.S. Cl. ..... 313/495; 313/496; 313/497; 313/489; 313/110

(58) Field of Search ..... 313/489, 634, 313/635, 582–587, 495–497, 326, 479

(56) References Cited

U.S. PATENT DOCUMENTS 4,792,716 A * 12/1988 Walsh ..... 313/635
5,377,029 A * 12/1994 Lee et al. ..... 359/54
5,808,410 A * 9/1998 Pinker et al. ..... 313/493
5,910,356 A * 6/1999 Ishikawa et al. ..... 313/479
5,935,717 A * 8/1999 Oishi et al. ..... 428/480
5,939,826 A * 8/1999 Ohsawa et al. ..... 313/582
5,945,209 A * 8/1999 Okazaki et al. ..... 428/402
5,972,517 A * 10/1999 Kondo et al. ..... 428/446
6,177,762 B1 * 1/2001 Nakayama ..... 313/582
6,329,751 B2 * 12/2001 Yoo ..... 313/582

* cited by examiner

*Primary Examiner*—Nimeshkumar D. Patel
*Assistant Examiner*—Mariceli Santiago
(74) *Attorney, Agent, or Firm*—Sonnenschein, Nath & Rosenthal

(57) ABSTRACT

A display includes means for generating plasma; means, provided on a specific surface of the plasma generating means, for preventing ultraviolet light, produced when the plasma is generated by the plasma generating means, from leaking outside; a liquid crystal layer which is made of liquid crystal and is disposed on the ultraviolet light leakage preventive means; and means for generating a potential difference between the plasma generating means and the electrode layer which is made from a transparent conductive oxide and is stacked on the liquid crystal layer. The provision of the ultraviolet light leakage preventive means prevents ultraviolet light, which is produced when plasma is generated, from leaking outside. This is effective to keep a stable light emission state of plasma and a stable quality of a displayed image.

4 Claims, 3 Drawing Sheets

PLASMA LIGHT EMITTING DEVICE AND DISPLAY USING SAME HAVING AN ULTRAVIOLET LIGHT LEAKAGE PREVENTING MEANS

RELATED APPLICATION DATA

The present application claims priority to Japanese Application No. P10 019108 filed Jan. 30, 1998 which application is incorporated herein by reference to the extent permitted by law.

BACKGROUND OF THE INVENTION

The present invention relates to a display and a plasma light-emitting device used for the display, and particularly to a plasma addressed liquid crystal (PALC) display (hereinafter, referred to simply as "display") and a plasma light-emitting device suitably used for the display.

As the display of this type, there is known a type shown in FIG. 3. For the sake of clarity, only one pixel of the display 1 is shown in FIG. 3.

Referring to FIG. 3, the display 1 includes a plasma light-emitting unit 12. In the plasma light-emitting unit 12, a first glass substrate 4 is stacked via a first sheet polarizer 3 on a backlight 2 formed of a dispersion type AC-drive type electroluminescence (EL) element. A cathode electrode 5 and an anode electrode 6 connected to a DC power supply 7 and/or an AC power supply 8 are disposed on the first glass substrate 4 at specific positions. An insulating layer 10 made from an insulating material such as glass is fixed on the first glass substrate 4 via O-rings 9 each being made from a rubber material such as Biton. An enclosed space 11, which is formed by the first glass substrate 4, O-rings 9 and insulating layer 10, is filled with an inert gas such as argon at a specific pressure.

In this plasma light-emitting unit 12, after the backlight 2 is turned on by an external control mean (not shown), specific voltages are applied to the cathode electrode 5 and anode electrode 6 from the DC power supply 7 and/or the AC power supply 8 in such a manner that the cathode electrode 5 comes into a negative potential relative to the anode electrode 6, to produce discharge, thereby generating plasma 13 in the space 11. The generation of the plasma 13 is able to produce charged particles (not shown) in the space 11.

On the insulating layer 10 of the plasma light-emitting unit 12 are sequentially stacked a liquid crystal layer 14 made from liquid crystal of, for example, twisted nematic (TN) type; a color filter layer 15 such as RGB vertical stripe type; an electrode layer 16, for example, made from a transparent conductive oxide having an electrically low resistance (for example, $SnO_2$ or ZnO); a second glass substrate 17; and a second sheet polarizer 18.

While not shown, potential difference generating means is connected between the electrode layer 16 and the anode electrode 6 within the plasma light-emitting unit 12 in order to generate a potential difference therebetween on the basis of the potential of the anode electrode 6.

The operation of this display 1 will be described below. A voltage, which is supplied between the electrode layer 16 and the anode electrode 6 from the potential difference generating means, is applied to the liquid crystal layer 14 and the insulating layer 10 by utilizing, as a switching element which is the charged particle produced when the plasma 13 is generated by the plasma light-emitting unit 12.

At this time, by applying the voltage the liquid crystal layer 14 is charged. When the charged particles disappear after an elapse of a specific time since completion of the discharge of the plasma 13, the inside of the space 11 comes into the insulating state and thereby any voltage is no longer applied to the liquid crystal layer 14. The liquid crystal layer 14 holds the stored charges until the next discharge occurs.

In this way, the display 1 is able to display an image by performing scanning in line sequence through operation of cutting off transmission light supplied from the backlight 2 or transmitting the light by control of the liquid crystal layer 14 in combination with operation of the first and second sheet polarizers 3 and 18.

The above display 1, however, has a problem that the liquid crystal layer 14 is deteriorated by ultraviolet light (not shown) produced when the plasma 13 is generated by the plasma light-emitting unit 12. Concretely, by the effect of ultraviolet light, rust gradually permeates into the liquid crystal layer 14, to discolor the liquid crystal layer 14 into yellow, thereby degrading an image displayed on the display 1.

Another problem of the above display 1 is that the insulating layer 10 formed of a thin film is easily cracked. This makes the handling characteristic poor. To solve this problem, it may be considered to form the insulating layer 10 using a high polymer material (plastic or the like) in place of glass. In this case, however, there occurs an inconvenience that the high polymer material is deteriorated, that is, discolored into yellow by the effect of ultraviolet light produced when the plasma 13 is generated, as described above.

Further, the latter manner using a high polymer material for forming the insulating layer 10 has another disadvantage. That is to say, since the insulating layer 10 made from a high polymer material allows moisture in atmospheric air and an inert gas sealed in the space 11 to excessively pass therethrough, it is difficult to keep the vacuum state constant within the space 11. As a result, each of the cathode electrode 5 and anode electrode 6 is easily stuck with impurities (for example, moisture in atmospheric air) by sputter generated in discharge, to shorten the service life of the cathode electrode 5 and the anode electrode 6, thereby degrading the life of light emission by the plasma 13. Also since the light emission amount of the plasma 13 is changed by the impurities, variation in pressure, and so on, it is difficult to keep a stable light emission state of the plasma 13 and a stable quality of a displayed image.

A further problem of the display 1 mentioned above is that the insulating layer 10 formed of a single thin film is deflected by a stress caused by the negative pressure in the space 11.

SUMMARY OF THE INVENTION

An object of the present invention is to provide a plasma light-emitting device capable of keeping a stable light emission state of plasma and a stable quality of a displayed image, and a display using the plasma light-emitting device.

To achieve the above object, according to an aspect of the present invention, there is provided a plasma light-emitting device including: means for generating plasma; and means, provided on a specific surface of the plasma generating means, for preventing ultraviolet light, produced when the plasma is generated by the plasma generating means, from leaking outside.

Consequently, in this plasma light-emitting device, it is possible to prevent ultraviolet light produced when the plasma is generated, from leaking outside, and hence to keep a stable light emission state of plasma and a stable quality of a displayed image.

According to another aspect of the present invention, there is provided a display including: means for generating plasma; means, provided on a specific surface of the plasma generating means, for preventing ultraviolet light, produced when the plasma is generated by the plasma generating means, from leaking outside; a liquid crystal layer which is made from liquid crystal and is disposed on the ultraviolet light leakage preventive means; an electrode layer which is made from a transparent conductive oxide and is stacked on the liquid crystal layer; and means for generating a potential difference between the plasma generating means and the electrode layer.

In this display, it is possible to prevent ultraviolet light which is produced when the plasma is generated, from leaking outside, hence to keep a stable light emission state of plasma and a stable quality of a displayed image.

DETAILED DESCRIPTION OF THE PREFERRED EMBODIMENT

Hereinafter, one embodiment of the present invention will be described in detail with reference to the drawings.

Figure 1:
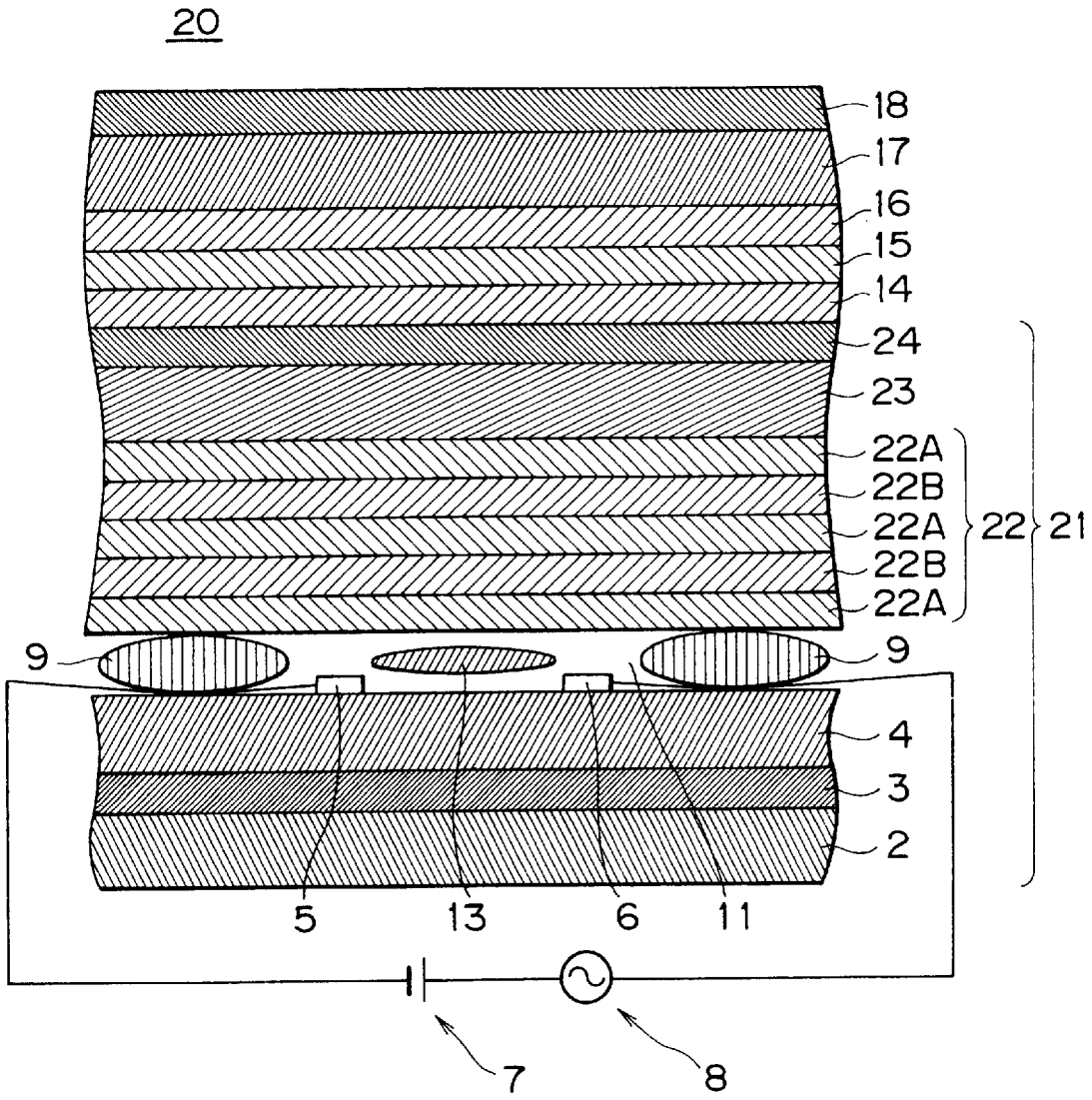
FIG. 1 is a sectional view showing the configuration of a PALC display according to an embodiment of the present invention.
Figure 3:
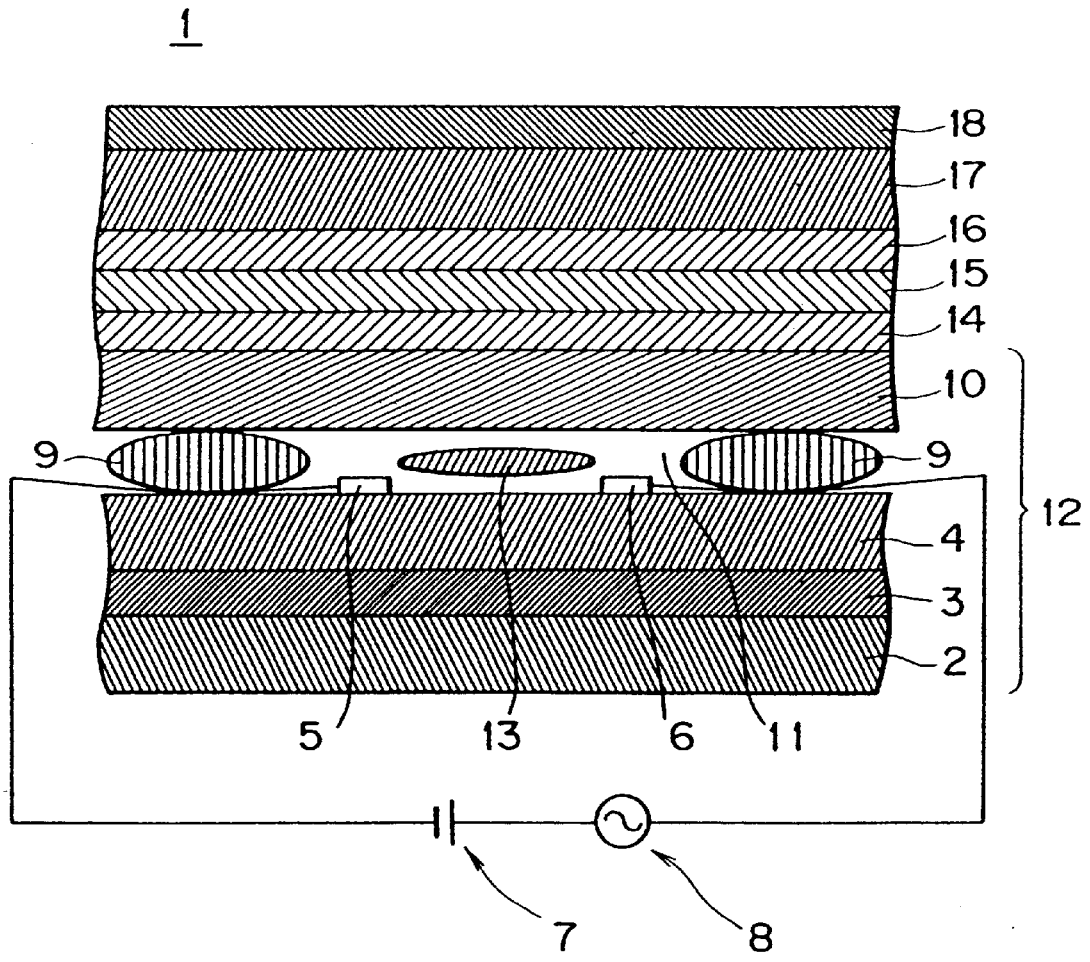
FIG. 3 PRIOR ART
FIG. 3 is a sectional view showing the configuration of a related art PALC display.

FIG. 1 is a sectional view showing the configuration of a PALC display according to one embodiment of the present invention. In this figure, parts corresponding to those shown in FIG. 3 are designated by the same reference numerals. A display in this embodiment, generally designated by reference numeral 20, has the same basic configuration as that of the display 1 shown in FIG. 3 except for the configuration of a plasma light-emitting unit 21.

In this display 20, the plasma light-emitting unit 21 includes an ultraviolet light leakage preventive layer 22 provided on O-rings 9. The ultraviolet light leakage preventive layer 22 is composed of high refraction layers 22A each of which is made from a conductive material having a high refractive index such as $TiO_2$, and low refraction layers 22B each of which is made from a conductive material having a low refractive index such as $SiO_2$. These high refraction layers 22A and low refraction layers 22B are sequentially, alternately stacked to each other. A protective layer 24 is stacked via an insulating layer 23 on the ultraviolet light leakage preventive layer 22.

The thickness of each of the high refraction layer 22A and the low refraction layer 22B is selected at a value corresponding to a wavelength of ultraviolet light, that is, at such a value that the ultraviolet light incident on the high refraction layer 22A or low refraction later 22B is canceled by the ultraviolet light reflected from the associated boundary plane between the high refraction layer 22A and the low refraction layer 22B.

With this configuration, the display 20 makes it possible to sequentially attenuate ultraviolet light (not shown), which is produced when the plasma 13 is generated by the plasma light-emitting unit 21, by interference of light at the high refraction layers 22A and the low refraction layers 22B within the ultraviolet light leakage preventive layer 22, and hence to prevent the ultraviolet light from leaking outside.

In this embodiment, the insulating layer 23 is formed of an insulating resin film such as a polycarbonate film, which layer 23 is effective to prevent an inert gas (not shown) such as argon sealed in the space 11 of the plasma light-emitting unit 21, from being transmitted outside through the layer 23, and also to improve the handling characteristic of the layer 23 as compared with the case using a brittle glass material.

In this embodiment, the protective layer 24 is made from an insulating material such as a teflon based insulating material, which layer 24 is effective to prevent an impurity (moisture or the like) in atmospheric air from permeating into the space 11 within the plasma light-emitting unit 21, and also to prevent contamination such as a fingerprint easily stuck thereon or allow the contamination stuck thereon easily wiped off.

The operation of the display 20 will be described below. In this display 20, after the backlight 2 is turned on by external control means (not shown), voltages are applied to the cathode electrode 5 and the anode electrode 6 from the DC power supply 7 and/or the AC power supply 8 in such a manner that the cathode electrode 5 comes into a negative potential relative to the anode electrode 6, to cause discharge, thereby generating plasma 13. The discharge is completed by returning the potential of the cathode electrode 5 equal to that of the anode electrode 6. At this time, charged particles (not shown) produced by discharge of the plasma 13 remain in the space 11. The charged particles come into a potential equal to that of the anode electrode 6 since they are conductive.

When a voltage is applied from an external voltage source (not shown) to the electrode layer 16 on the basis of the potential of the anode electrode 5, such a voltage is applied to the liquid crystal layer 14 via the ultraviolet light leakage preventive layer 22, insulating layer 23 and protective layer 24 with the charged particles taken as a switching element. At this time, the liquid crystal layer 14 applied with the voltage is charged. When charged particles disappear after an elapse of a specific time passing since completion of discharge of the plasma 13, the inside of the space 11 comes into the insulating state, so that any voltage is no longer applied to the liquid crystal 14. The liquid crystal layer 14 holds the stored charges until the next discharge occurs.

In this way, the display 20 is able to display an image by performing scanning in line sequence through operation of cutting off transmission light supplied from the backlight 2 or transmitting the light by control of the liquid crystal layer 14 in combination with operation of the first and second sheet polarizers 3 and 18.

At this time, in the display 20, the ultraviolet light produced when the plasma 13 is generated by the plasma light-emitting unit 21, is sequentially attenuated by interference of light at the high refraction layers 22A and the low refraction layers 22B within the ultraviolet light leakage preventive layer 22, and is thus prevented from being leaked outside. As a result, the display 20 makes it possible to prevent permeation of rust into the liquid crystal layer 14 and hence to prevent degradation of a displayed image due to discoloration of the liquid crystal display 14 into yellow.

When this embodiment was carried out, the ultraviolet light leakage preventive layer 22 was formed by sequentially stacking three layers of the high refraction layers 22A and two layers of the low refraction layers 22B to each other by a sputtering process. In this case, $TiO_2$ (refractive index: 2.0) and $SiO_2$ (refractive index: 1.5) were used as the high refraction material and the low refraction material, respectively. The each thickness of the sequentially stacked refraction layers are as follows respectively: 22.4 nm (first high refraction layer 22A), 70.5 nm (second low refraction layer 22B), 44.8 nm (third high refraction layer 22A), 70.5 nm (fourth low refraction layer 22B) and 22.4 nm (fifth high refraction layer 22A). Then, the insulating layer 23 having a thickness of 188 $\mu$m and the protective layer 24 having a thickness of 10 nm to 50 $\mu$m were sequentially formed on the ultraviolet light leakage preventive layer 22 by sputtering. The layer structure was disposed on the O-rings 9 with the ultraviolet light leakage preventive layer 22 facing to the first glass substrate 4, to thus form the plasma light-emitting unit 21. As the result of testing using such a plasma light-emitting unit 21, it was confirmed to practically prevent ultraviolet light from leaking outside through the protective layer 24. Accordingly, it was confirmed that the plasma light-emitting unit 21 of the display 20 thus obtained is capable of practically preventing rust from permeating into the liquid crystal layer 14 thereby avoiding discoloration of the liquid crystal layer 14 into yellow.

This display 20 is also advantageous in that since the plurality of layers, that is, the ultraviolet light leakage preventive layer 22, insulating layer 23 and protective layer 24 are stacked on the O-rings 9 in the plasma light-emitting unit 21, the ultraviolet light leakage preventive layer 22, insulating layer 23 and protective layer 24 are prevented from recessedly deflected by a stress due to the negative pressure in the space 11.

With this configuration, since the ultraviolet light leakage preventive layer 22, which includes the high refraction layers 22A and the low refraction layers 22B sequentially, alternately stacked to each other, is formed on the O-rings 9 in the plasma light-emitting unit 21, it is possible to prevent ultraviolet light, which is produced when the plasma 13 is generated in the space 11 of the plasma light-emitting unit 21, from leaking outside by sequentially attenuating the ultraviolet light through interference of light at the ultraviolet light leakage preventive layer 22. This makes it possible to prevent degradation of a displayed image due to discoloration of the liquid crystal layer 14 into yellow caused by permeation of rust into the liquid crystal layer 14, and hence to realize the display 20 capable of keeping a stable emission state of the plasma 13 and a stable quality of a displayed image.

The plasma light-emitting unit 21 is applied to the PALC display 20 in the above embodiment; however, the present invention is not limited thereto. The plasma light-emitting unit 21 of the present invention may be applied to various devices of a type making use of light emission by plasma, such as other display devices, plasma display panels (PDPS) and fluorescent lamps.

The insulating layer 23 as pressure holding means is formed of the polycarbonate film in the above embodiment; however, the present invention is not limited thereto. The insulating layer 23 may be made from polyethylene terephthalate, polyethylene naphthalate or a teflon based material.

The protective layer 24 as impurity permeation preventive means is made from the teflon based insulating material in the above embodiment; however, the present invention is not limited thereto. The protective layer 24 may be made from any material capable of preventing an external impurity, such as moisture, from permeating in the space 11 of the plasma light-emitting unit 21.

The high refraction layer 22A is made from $TiO_2$ in the above embodiment; however, the present invention is not limited thereto. The high refraction layer 22A may be made from a conductive material having a high refractive index, such as TiOx (x=0.5 to 2), TixNy (x=0.5 to 2, y=0.5 to 4), NbxOy (x=0.5 to 2, y=0.5 to 5).

The low refraction layer 22B is made from $SiO_2$ in the above embodiment; however, the present invention is not limited thereto. The low refraction layer 22B may be made from a conductive material having a low refractive index, such as SiOx (x=0.5 to 2).

The ultraviolet light leakage preventive layer 22 as ultraviolet light leakage preventive means is formed by stacking three layers of the high refraction layers 22A and two layers of the low refraction layers 22B in the above embodiment; however, the present invention is not limited thereto. The number of the stacked high refraction layers 22A and low refraction layers 22B is not particularly limited insofar as the ultraviolet light leakage preventive layer 22 having a refractive index of about 1.2 to 1.4 is formed in a combination of the conductive material having a high refractive index and the conductive material having a low refractive index.

Figure 2:
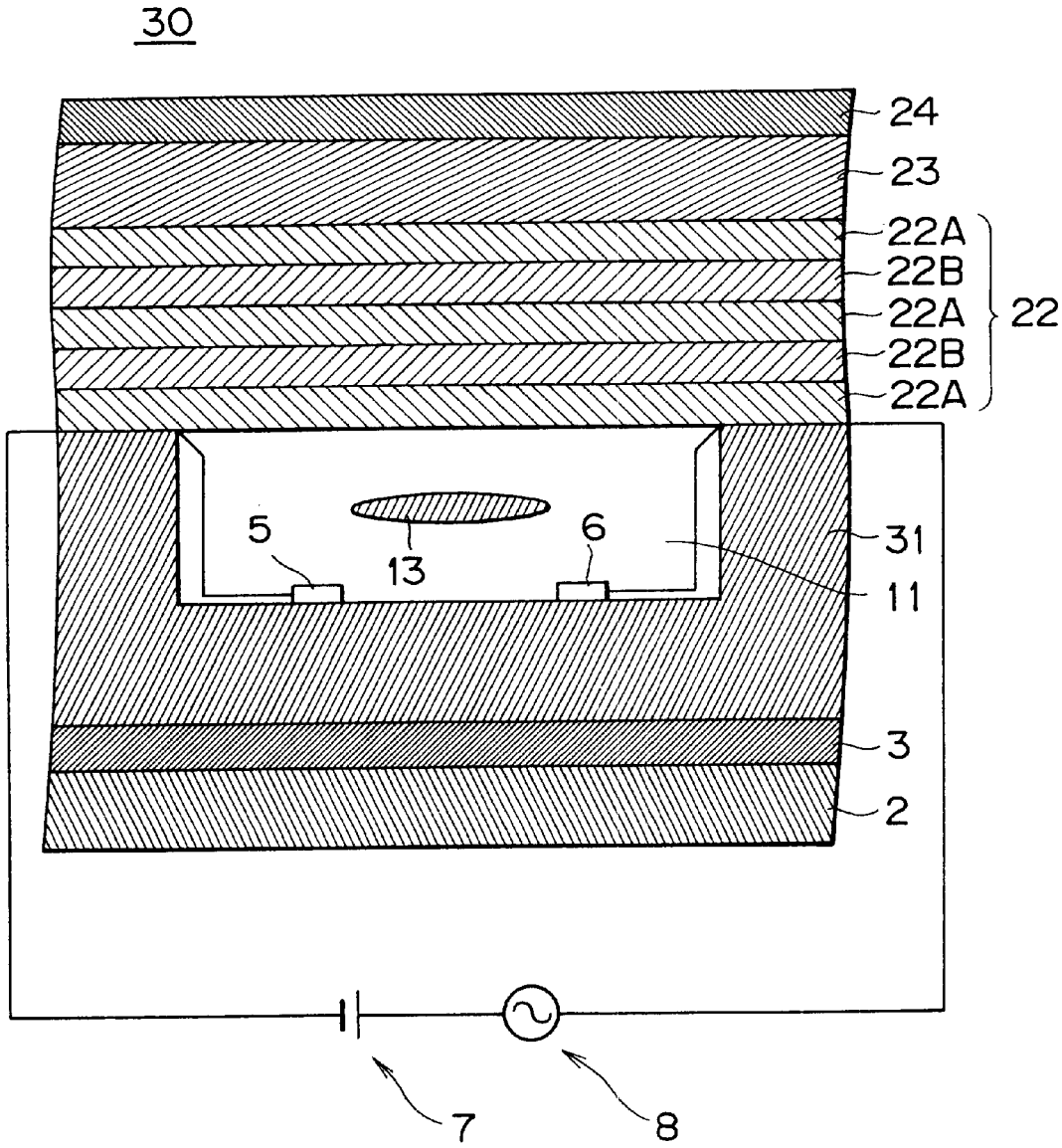
FIG. 2 is a sectional view showing the configuration of a plasma light-emitting device according to a modification of the embodiment of the present invention.

The space 11 is formed via the O-rings 9 between the first glass substrate 4 and the ultraviolet light leakage preventive layer 22; however, the present invention is not limited thereto. According to the present invention, the air-tight space 11 is formed between the first glass substrate 4 and the ultraviolet leakage preventive layer 22. For example, there may be adopted a modification shown in FIG. 2. In this figure, parts corresponding to those in FIG. 1 are designated by same reference numerals. That referring to FIG. 2, a first glass substrate 31 (equivalent to the first glass substrate 4 in the above embodiment) of a plasma light-emitting unit 30 is formed in a recessed shape to form an air-tight space 11 between the first glass substrate 31 and the ultraviolet light leakage preventive layer 22, is acceptable. Further, the first glass substrate 4 in the above embodiment may be fixed to the ultraviolet light leakage preventive layer 22 using an adhesive such as a silicon resin adhesive to form an air-tight space 11 therebetween.

Further, argon is used as an inert gas in the above embodiment; however, the present invention is not limited thereto. For example, xenon, helium, neon or the like may be used as an inert gas.

While the preferred embodiment of the present invention has been described using specific terms, such description is for illustrative purposes only, and it is to be understood that changes and variations may be made without departing from the spirit or scope of the following claims.

What is claimed is:

1. A plasma light-emitting device, comprising:

means for generating plasma;

means, provided on a specific surface of said plasma generating means, for preventing ultraviolet light which is produced when the plasma is generated by said plasma generating means from leaking outside, the ultraviolet light preventive means comprising a plurality of high refraction layers each being made from a conductive material having a high refractive index and has a specific thickness corresponding to a wavelength of said ultraviolet light and a plurality of low refraction layers each being made from another conductive material having a low refractive index and has another specific thickness corresponding to the wavelength of said ultraviolet light wherein said plurality of high refraction layers and said plurality of low refraction layers are sequentially, alternately stacked to each other;

an insulating layer positioned on the ultraviolet light leakage preventive means, the insulating layer being capable of sealing an inert gas within the plasma light emitting device; and a protective layer which is made from a water-repellent material and is stacked on said ultraviolet light leakage preventive means.

2. A display, comprising:

means for generating plasma;

means, provided on a specific surface of said plasma generating means, for preventing ultraviolet light produced when the plasma is generated by said plasma generating means from leaking outside, the ultraviolet light preventive means comprising a plurality of high refraction layers each being made from a conductive material having a high refractive index and has a specific thickness corresponding to a wavelength of said ultraviolet light and a plurality of low refraction layers each being made from another conductive material having a low refractive index and has another specific thickness corresponding to the wavelength of said ultraviolet light wherein said plurality of high refraction layers and said plurality of low refraction layers are sequentially, alternately stacked to each other;

a liquid crystal layer which is made from liquid crystal and is disposed on said ultraviolet light leakage preventive means;

an electrode layer which is made from a transparent conductive oxide and is stacked on said liquid crystal layer;

an insulating layer positioned on the ultraviolet light leakage preventive means, the insulating layer being capable of sealing an inert gas within the plasma light emitting device, the insulating layer further being capable of preventing stress deflection caused by negative pressure within the display;

a protective layer which is made from a water-repellent material and is stacked on said ultraviolet light leakage preventive means; and means for generating a potential difference between said plasma generating means and said electrode layer.

3. A plasma-light emitting device, comprising:

a plasma generator;

an ultraviolet light leakage preventive layer provided on a specific surface of the plasma generator to prevent ultraviolet light produced when the plasma is generated by the plasma generator from leaking outside, the ultraviolet light preventive layer comprising a plurality of high refraction layers and a plurality of low refraction layer wherein each of the plurality of high refraction layers is made from a conductive material having a high refractive index and has a specific thickness corresponding to a wavelength of the ultraviolet light and wherein each of the plurality of low refraction layers is made from another conductive material having a low refractive index and has another specific thickness corresponding to the wavelength of the ultraviolet light;

an insulating layer positioned on the ultraviolet light leakage preventive layer, the insulating layer being capable of sealing an inert gas within the plasma-light emitting device; and a protective layer which is made from a water-repellent material and is stacked on the ultraviolet light leakage preventive layer, wherein the ultraviolet light leakage preventive layer, the insulating layer and the protective layer are configured to prevent stress deflection caused by negative pressure within the display.

4. The plasma light-emitting device of claim 3, further comprising a recessed shaped space between a glass substrate and the ultraviolet light leakage preventive layer.

* * * * *